US005662176A

United States Patent [19]

Madgwick et al.

[11] Patent Number: 5,662,176

[45] Date of Patent: Sep. 2, 1997

[54] TRUCK MOUNTED WORK IMPLEMENT

[75] Inventors: Kenneth B. Madgwick, 2709 N. 7th St., Garden City, Kans. 67846; Randall M. Friesen, Garden City, Kans.

[73] Assignee: Kenneth B. Madgwick, Garden City, Kans.

[21] Appl. No.: 675,859

[22] Filed: Jul. 5, 1996

Related U.S. Application Data

[63] Continuation of Ser. No. 388,155, Feb. 13, 1995, Pat. No. 5,558,169.

[51] Int. Cl.[6] ..... E21B 7/02

[52] U.S. Cl. ..... 173/185; 173/28

[58] Field of Search ..... 173/24, 45, 26, 173/27, 28, 29, 46, 184, 185, 186, 187, 188, 189; 175/162

[56] References Cited

U.S. PATENT DOCUMENTS

| | | | |
|---|---|---|---|
| 2,959,398 | 11/1960 | Troche | 173/38 |
| 3,073,397 | 1/1963 | Balogh | 173/28 |
| 3,509,723 | 5/1970 | Dorn | 173/184 X |
| 3,771,610 | 11/1973 | Leyrat | 173/46 |
| 3,789,931 | 2/1974 | Quinn | 173/185 |
| 4,697,648 | 10/1987 | Brandt | 173/28 X |
| 4,961,471 | 10/1990 | Ovens | 173/185 |
| 4,998,590 | 3/1991 | Wells | 173/28 X |
| 5,012,873 | 5/1991 | Kennedy et al. | 173/185 |

FOREIGN PATENT DOCUMENTS 675274 12/1963 Canada .

*Primary Examiner*—Joseph J. Hail, III
*Assistant Examiner*—Jay A. Stelacone
*Attorney, Agent, or Firm*—Larry W. Miller

[57] ABSTRACT

A supporting frame mounting a work implement, such as a post hole digger, is disclosed wherein the supporting frame is connected to a standard snow plow mount at the front of a truck. The supporting frame includes a fixed base member affixed to the snow plow mount and supporting a rotatable base portion by a slew bearing. The supporting frame further includes a double arm boom member pivotally connected to the rotatable base member and a single arm boom member pivotally connected to the double arm boom member to provide a compact nesting configuration for transport. The work implement is affixed to the single arm boom member by a pivot and a swivel to permit a self-seeking vertical orientation by gravity. A hydraulic system powers the pivotal movement of the boom members and the rotatable base member, as well as the operation of the work implement. The hydraulic operations are effected by manipulation of a pair of joy stick controllers that are pivotally movable between an upright transport position and a tilt-out operative position. Stability for the supporting frame is attained through a pair of opposing support legs pivotally connected to the fixed base member, the pivotal movement of which is effected through a ratchet mechanism. The extensible boom members and rotatable base member provide a great range of operation for the work implement from each resting position of the truck.

14 Claims, 7 Drawing Sheets

40
20
41
45
35
47
10
12
14
33
36
15
14
20
41
35
49
48
G
60
22
40
43
44
46
45
47

10
12
60
45
14
14
20
35
41
26
26

3a
3a
8
8

TRUCK MOUNTED WORK IMPLEMENT

CROSS-REFERENCE TO RELATED APPLICATIONS

This application is a continuation of U.S. patent application Ser. No. 08/388,155, filed Feb. 13, 1995, and issued as U.S. Pat. No. 5,558,169, on Sep. 24, 1996.

BACKGROUND OF THE INVENTION

This invention relates generally to a work implement mounted on the front of a truck, and more particularly, to a hydraulically powered work implement, such as a post hole digger, supported from the snow plow mounting apparatus.

Work implements, such as a post hole digger or a post driver, are mounted in trucks, tractors or other vehicles for transport from location to location and for connection to a primary source of power, which can be mechanical or hydraulic. Some such implements have their own mounting frame and supporting framework, such as described in U.S. Pat. No. 4,961,471, issued on Oct. 9, 1990, but do not adequately re-configure into a compact transport position to permit the mounting thereof at the front of a vehicle for a rapid and safe transport of such mechanisms over the highway.

Other known post hole digger mechanisms, such as described in U.S. Pat. Nos. 3,710,875, issued on Jan. 16, 1973; 3,700,045, issued on Oct. 24, 1972; and 3,789,931, issued on Feb. 5, 1974, are centrally located at the rear a tractor and mounted to the three-point hitch structure or at the front of the tractor and supported on a specialty frame. Such tractor mounted work implements are not movable into a compact transport position and are, therefore, also not intended for rapid transport over the highways, as is necessary if mounted on a truck. Furthermore, such three-point mounted work implements have a limited range of operation. The implement must be located over the site to be operated by manipulating the position of the tractor, which is further exacerbated by the mounting of the work implement at the rear of the vehicle.

The operative range through which the work implement can be employed without relocating the vehicle to which the implement is attached is improved by specialty mounting mechanisms, such as shown and described in U.S. Pat. Nos. 5,273,124, issued on Dec. 28, 1993; in 3,754,604, issued on Aug. 28, 1973; and in 4,610,314, issued on Sep. 9, 1986. Such specialty mounting mechanisms do not provide the flexibility of easy and convenient detachment when the work implement is not needed and the vehicle is desired for use in some other operation. Furthermore, the transport configuration of the specialty mounting mechanisms are not very compact and, therefore, are placed at positions other than the front of the vehicle.

Other work implements, such as that shown and described in U.S. Pat. Nos. 3,771,610, issued on Nov. 13, 1973, and in 3,240,278, issued on Mar. 15, 1966, provide a wide range of operation for the work implement, but are clearly not intended for placement into a compact transport configuration or for rapid transport over the highway with the mounting thereof on a truck.

In would be desirable to provide a framework for the mounting of a work implement, such as a post hole digger, that can be mounted on the front of a truck, utilizing the standard mounting apparatus for a snow plow, yet provide a range of operation for utilization of the work implement while providing for a compact transport configuration to enable the work implement and supporting framework to remain mounted at the front of the truck for rapid transport over the highway.

SUMMARY OF THE INVENTION

It is an object of this invention to overcome the aforementioned disadvantages of the prior art by providing an extensible supporting frame for a work implement to be mounted on the standard snow plow mounting apparatus at the front of a truck.

It is another object of this invention to provide a supporting framework for a work implement that can be compactly nested at the front of a truck.

It is a feature of this invention that the transport configuration of the supporting frame incorporates the work implement in a compact nesting orientation at the from of the truck.

It is an advantage of this invention that the compact nesting configuration of the work implement and supporting frame enables the rapid transport of the mechanism over the highway.

It is another advantage of this invention that the compact nesting configuration of the work implement and supporting frame enables the work implement to remain mounted at the front of the truck while being transported over the highway.

It is still another object of this invention to mount the work implement supporting frame to the standard mounting apparatus for a snow plow at the front center portion of a truck.

It is another feature of this invention that the supporting frame for the work implement includes a rooster comb device to permit the mounting of the supporting frame to a variety of snow plow mounting mechanisms.

It is still another advantage of this invention that the rooster comb device allows the supporting frame to be mounted in its proper orientation irrespective of the length of the top mounting arm of the snow plow mount to which the supporting frame is to be attached.

It is still another feature of this invention that the mounting mechanism further includes a latching member that captures a mounting pin within the rooster comb device to secure the supporting frame to the standard snow plow mounting apparatus.

It is yet another object of this invention to provide a supporting frame that allows an extensible range of operation for the mounted work implement, yet is convertible into a compact nesting configuration for transport over the highway.

It is yet another feature of this invention that the supporting frame includes a pair of pivoted boom members that provide an extensible range of operation from a base frame member affixed to the standard snow plow mounting apparatus.

It is yet another feature of this invention that the first pivoted boom member is a double armed boom to which a single armed second boom member is pivotally connected to allow the second boom member to nest within the first boom member when moved into a transport configuration.

It is yet another advantage of this invention that the nesting boom arm configuration enables the supporting frame to achieve a compact transport position with the work implement cradled into the nested configuration.

It is a further feature of this invention that the base frame member includes a slew bearing to allow a rotatable base frame portion to rotate about a generally vertical axis.

It is a further advantage of this invention that the range of operation of the work implement is enlarged by the rotational capability of the base frame member supporting the pivoted boom members.

It is yet another feature of this invention that the work implement is mounted to the second boom member by a swivel and pivot connection to permit the work implement to seek a vertical orientation by gravity irrespective of the relative positions of the boom members.

It is a further feature of this invention that the second boom member carries a cradle against which the work implement can be secured to facilitate the compact nesting configuration of the transport position.

It is a further object of this invention that the first pivoted boom member carries a hook to permit the pivoted boom arm to be used as a post puller.

It is still a further object of this invention to control the operation of the work implement through a hydraulic control mechanism that is movable between an operative position and a transport position in which the control mechanism is protected from damage.

It is still a further feature of this invention that the hydraulic control mechanism utilizes joy stick controllers that rotate from an upright transport position to a tilt-out operative position with the movement of a cover to permit access to the joy stick controllers.

It is still a further advantage of this invention that the cover protects the joy stick controllers from damage when in a transport position.

It is yet a further feature of this invention that the hydraulic system bleeds off a predetermined flow of hydraulic fluid to the hydraulic valves operated by the joy stick controllers, while diverting the remainder of the flow to the work implement for operation thereof.

It is still another feature of this invention that the hydraulic system re-combines the full flow of hydraulic fluid to the work implement in the event the predetermined flow of hydraulic fluid diverted for operation of the hydraulic valves is not utilized.

It is yet a further advantage of this invention that the operator has the same feel of operation through the joy stick controllers irrespective of the size of the hydraulic system to which the work implement is attached.

It is the primary object of this invention to provide a post hole digger for connection with a standard snow plow mount on a truck that provides great flexibility in use and compact storage for transport over the highway.

It is still a further object of this invention to provide a supporting frame for a work implement, such as a post hole digger, to be mounted on a standard snow plow mount at the front of a truck which is durable in construction, inexpensive of manufacture, carefree of maintenance, facile in assemblage, and simple and effective in use.

These and other objects, features and advantages are accomplished according to the instant invention by providing a supporting frame mounting a work implement, such as a post hole digger, wherein the supporting frame is connected to a standard snow plow mount at the front of a truck. The supporting frame includes a fixed base member affixed to the snow plow mount and supporting a rotatable base portion by a slew bearing. The supporting frame further includes a double arm boom member pivotally connected to the rotatable base member and a single arm boom member pivotally connected to the double arm boom member to provide a compact nesting configuration for transport. The work implement is affixed to the single arm boom member by a pivot and a swivel to permit a self-seeking vertical orientation by gravity.

A hydraulic system powers the pivotal movement of the boom members and the rotatable base member, as well as the operation of the work implement. The hydraulic operations are effected by manipulation of a pair of joy stick controllers that are pivotally movable between an upright transport position and a tilt-out operative position. Stability for the supporting frame is attained through a pair of opposing support legs pivotally connected to the fixed base member, the pivotal movement of which is effected through a ratchet mechanism. The extensible boom members and rotatable base member provide a great range of operation for the work implement from each resting position of the truck.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
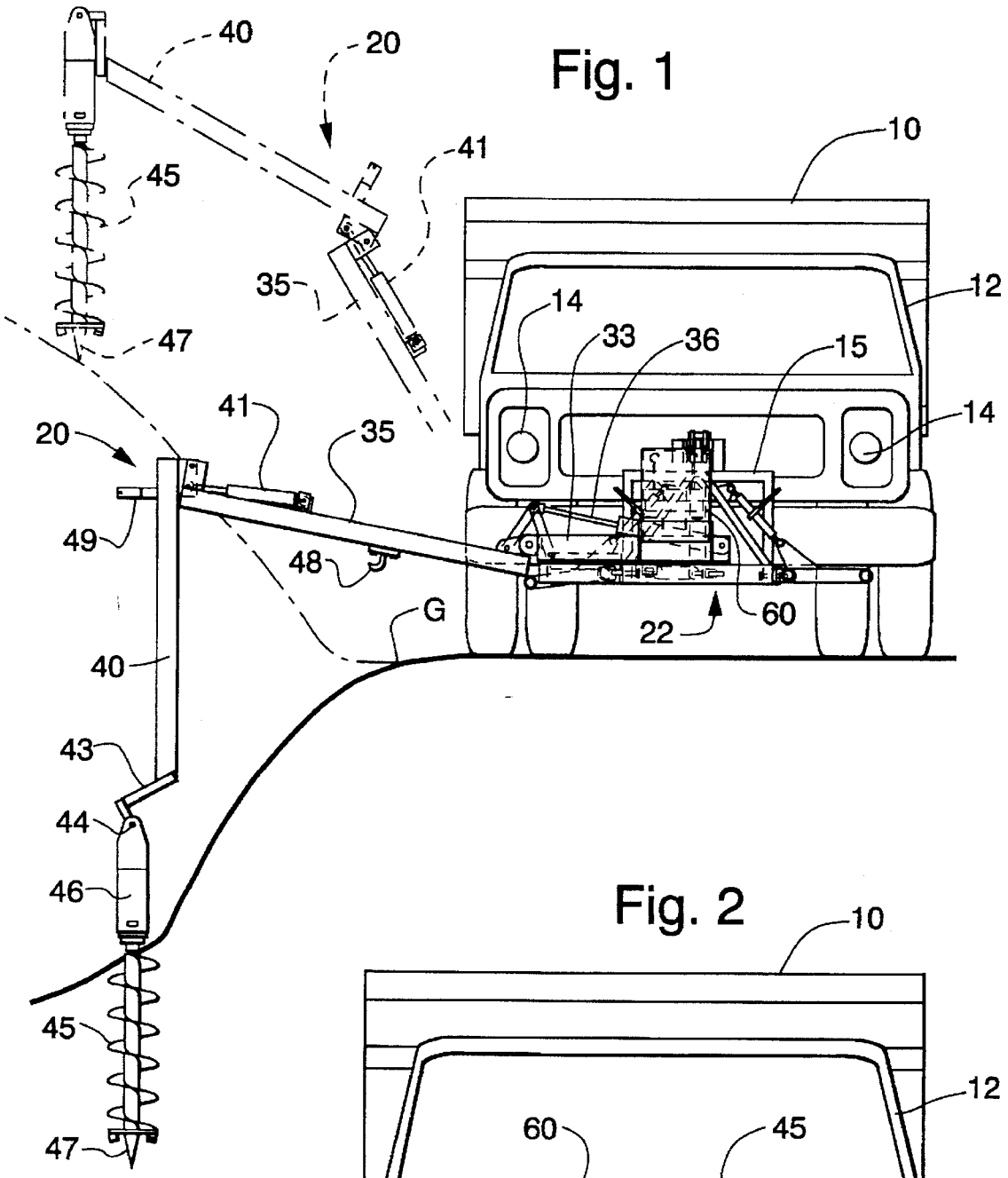
FIG. 1 is a front elevational view of a truck having mounted thereon a supporting frame and work implement, shown in the form of a post hole digger, incorporating the principles of the instant invention, the boom members being extending into an operative position with the vertical range of operation being depicted by a comparison between the solid lines and the phantom line indications of the boom members and work implement.
Figure 2:
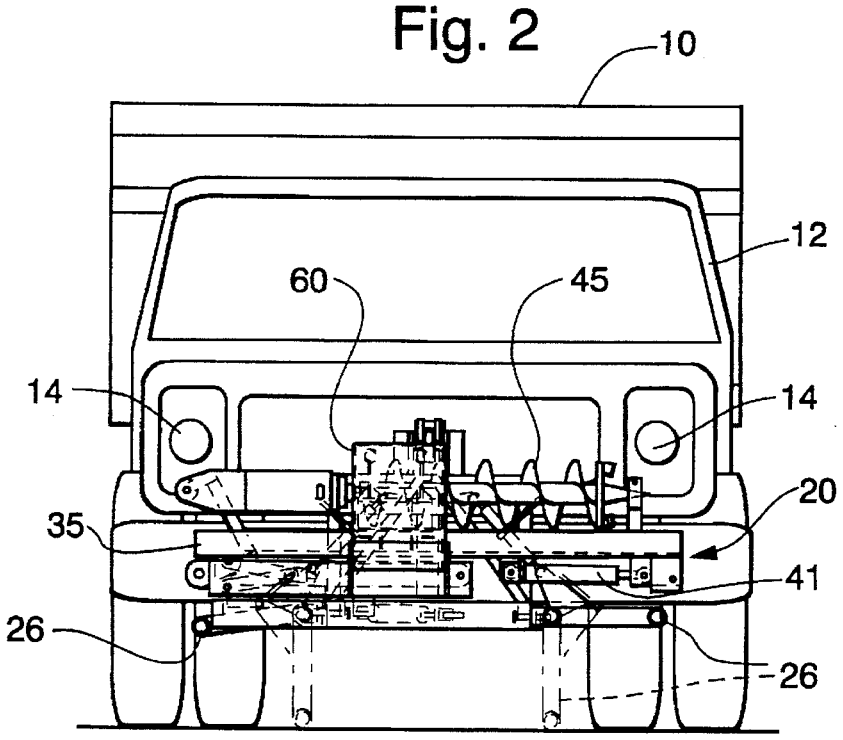
FIG. 2 is a front elevation view of a truck similar to that of FIG. 1, but with the supporting frame and work implement being compactly folded into a nested transport position, the pivotal movement of the support legs being shown in phantom.

Referring now to the drawings and, particularly, to FIGS. 1 and 2, a representative view of a supporting frame mounted to a standard snow plow mounting apparatus at the front of a truck and incorporating the principles of the instant invention can best be seen. Any left and right references are used as a matter of convenience and are determined from the normal reference of the operator's cab 12 of the truck 10 facing the supporting frame 20 mounted to the forward portion thereof in the normal direction of travel. With additional reference to FIG. 4, the truck 10 is provided with a conventional snow plow mounting apparatus 15 positioned at the forward end thereof. The mounting apparatus 15 includes a pair of lateral spaced lower pins 16 and a single upper mounting arm 18 having a transversely extending hole 19 therethrough. One skilled in the art will note that the nested transport orientation of the supporting frame 20 and work implement 45 does not occlude light emanating from the truck headlights 14.

Referring now to FIGS. 1–4, one skilled in the art can see that the supporting frame 20 includes a base frame portion 22 having a transversely extending base frame member 23 and a generally vertical A-frame tower 25. The base frame member 23 is fixed to the lower pins 16 of the snow plow mounting apparatus 15, while the A-frame tower 25 is connected to the upper mounting arm 18. The specifics of the connection between the tower 25 and the upper mounting arm 18 are described in greater detail below.

The base frame member 23 carries a pair of laterally spaced support legs 26 pivotally connected thereto. The support legs 26 are pivotally movable between raised transport positions shown in solid lines in FIG. 2 and a lowered operative position in which the support legs 26 engage the ground G, as shown in phantom in FIG. 2, to provide support and stability to the supporting frame. The pivotal movement of the support legs 26 is controlled through a conventional ratchet mechanism 28 extending between each opposing side of the tower 25 and the corresponding support leg 26. The ratchet mechanism 28 is operated through manipulation of the handle 29 which can selectively extend or contract the ratchet mechanism 28 and effect a corresponding pivotal movement of the support legs 26. One skilled in the art will readily realize that other devices to control the movement of the support legs 26, such as hydraulic cylinders, or even the movable configuration of the support legs 26 will be equally applicable.

Figures 3, 3A, 3B:
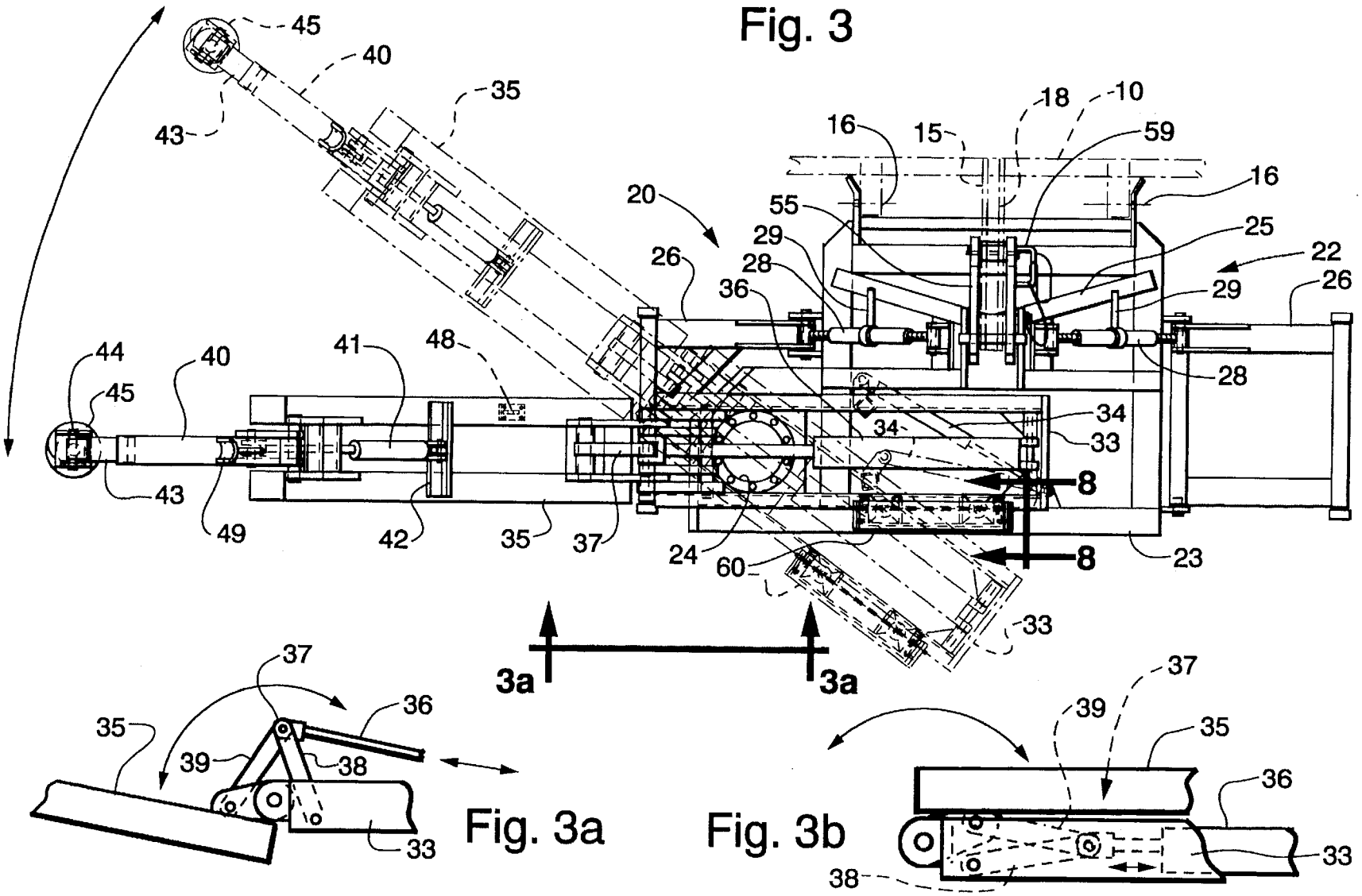
FIG. 3 is a top plan view of the supporting frame and attached work implement in an operative position, the rotational movement of the supporting frame through a generally horizontal arc of approximately 37° being depicted in phantom, the front portion of the truck to which the supporting frame is mounted also being shown in phantom.
FIG. 3*a* is a partial elevational detail view of the pivotal connection between the double arm boom member and the rotatable base member corresponding to lines 3*a*—3*a* of FIG. 3 with the boom member being extended into an operative position.
FIG. 3*b* is a partial elevational detail view similar to that of FIG. 3*a*, except that the boom member is moved into the nested transport position.

The fixed base frame member 23 mounts a slew bearing 24 at one lateral side thereof. The slew bearing 24 must be operable to withstand the entire radial and moment load imposed thereon by the operation of the supporting frame 20 and the attached work implement 45, even in the extreme outer limits of the range of operation thereof. A rotatable base frame member 33 is attached to the slew bearing 24 to permit a relative rotation movement between the rotatable base frame member 33 and the fixed base frame member 23. The rotational movement of the rotatable base frame member 33 is powered through the operation of a first hydraulic cylinder 34 interconnecting the fixed and rotatable base frame members 23, 33. As best seen in FIG. 3, the rotational movement is limited by the interference between structural components to a generally horizontal arc of approximately 37° to define the lateral limits of the range of operation of the work implement 45.

Figure 4:
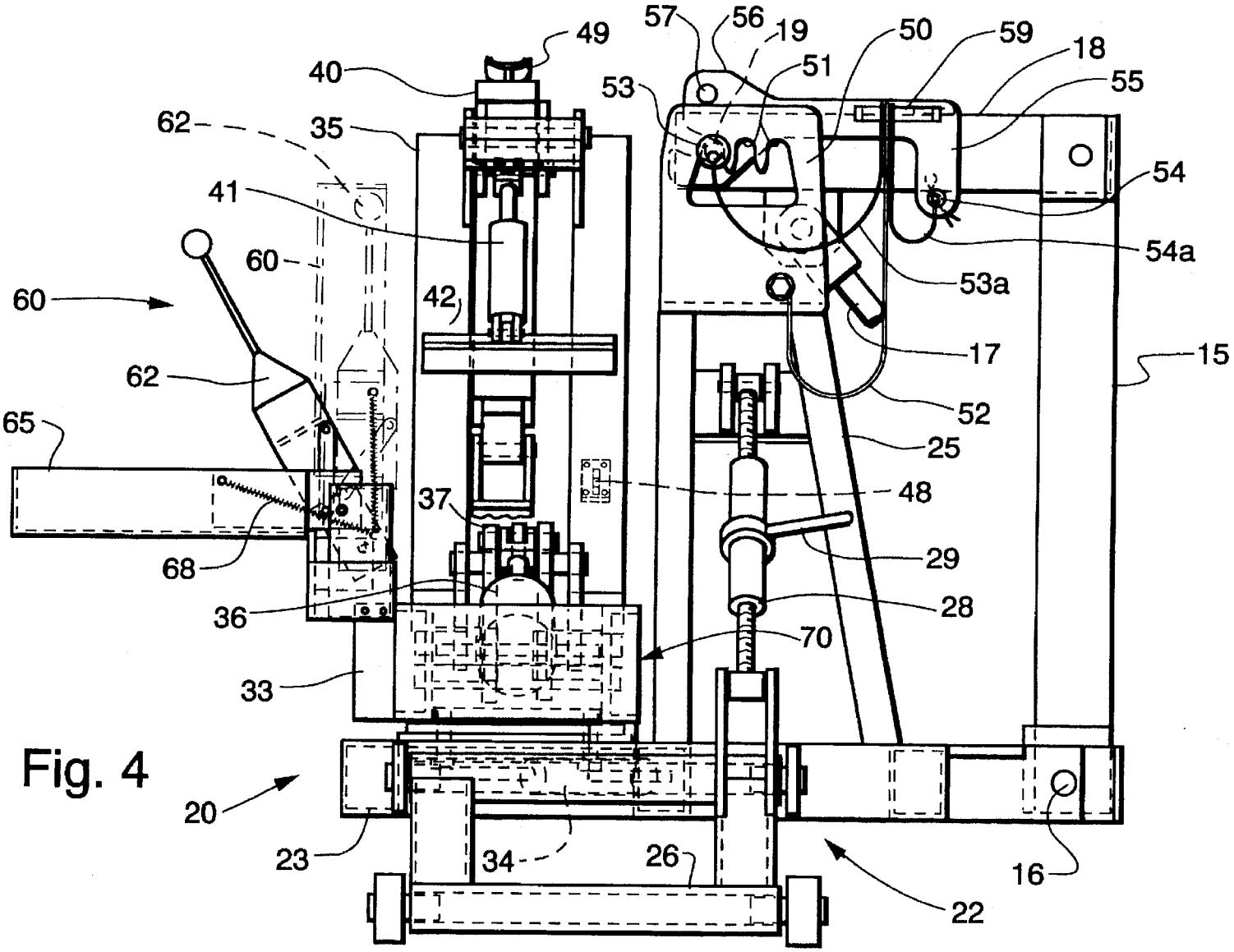
FIG. 4 is a left side elevational view of the supporting frame with the boom members being extended into an operative position, the pivotal movement of the joy stick controllers and the cover member being shown in phantom, the standard hydraulic cylinder controlling the upper snow plow mount member being broken away for purposes of clarity.

The supporting frame 20 further includes a first boom member 35 having a spaced double arm configuration, as best seen in FIGS. 3 and 4. The first boom member 35 is pivotally connected to the rotatable base frame member 33 in a manner to be rotatable relative thereto through approximately 170° of rotation from a nested transport position seen in FIG. 2 to the fully extended operational position seen in FIG. 1. The pivotal movement of the first boom member 35 is effected through operation of a second hydraulic cylinder 36 lying between the opposing arms of the first boom member 35 and interconnecting the rotatable base frame member 33 and the first boom member 35.

As best seen in FIGS. 3*a* and 3*b*, the connection between the second hydraulic cylinder 36 and the first boom member 35 to enable the approximately 170° of rotational movement, involves a connecting linkage 37 having a first link 38 pivotally interconnecting the rotatable base frame member 33 and the clevis of the second hydraulic cylinder 36 and a second link 39 pivotally interconnecting the clevis of the second hydraulic cylinder 36 and the first boom member 35. The provision of the two links 38, 39 enable the second hydraulic cylinder 36 to extend sufficiently to effect the nearly 170° of pivotal movement of the first boom member relative to the rotatable base frame member 33 without interfering with the pivotal connection therebetween.

The supporting frame 20 still further includes a second boom member 40 pivotally connected to the distal end of the first boom member 35 between the respective arms thereof, such that the second boom 40 can nest between the arms of the first boom member 35 as best seen in FIG. 2. The pivotal movement of the second boom member 40 relative to the first boom member 35 is controlled through a third hydraulic cylinder 41 supported from a strut 42 spanning the double arms of the first boom member 35 and connected to the second boom member 40 to effect an extensible pivotal movement upon the extension of the third hydraulic cylinder 41.

As best seen in FIG. 1, the second boom member 40 is provided at its distal end with a swivel joint 43 permitting a rotational movement about the axis thereof and a pivot joint 44 to which the work implement 45 is mounted. The combination of the swivel joint 43 and the pivot 44 allows the work implement 45 to seek a vertical orientation through gravity when freely dangled from the distal end of the second boom member 40, as the only connection of the work implement 45 to the second boom member 40 is through the pivot 44, which in turn is connected to the swivel joint 43 to allow the self-seeking vertical orientation. The work implement 45 is preferably powered in operation through a conventional hydraulic motor 46 connected via hydraulic lines (not shown) supported by the first and second boom members 35, 40 to provide a source of hydraulic fluid under pressure from the truck 10.

Referring now to FIGS. 4–7, the details of the mounting of the supporting frame 20 to the snow plow mounting apparatus 15 can best be seen. While the lower pins 16 of the mounting apparatus 15 are consistent from one snow plow manufacturer to another, the length of the upper mounting arm 18 varies from manufacturer to manufacturer. To enable the supporting frame 20 to be utilized with all known snow plow configurations, the A-frame tower 25 is provided with a rooster comb device 50 that defines a plurality of separate mounting grooves 51 spaced in a fore-and-aft manner to align with the transverse hole 19 in the end of the mounting arm irrespective of the snow plow manufacturer.

Figure 5:
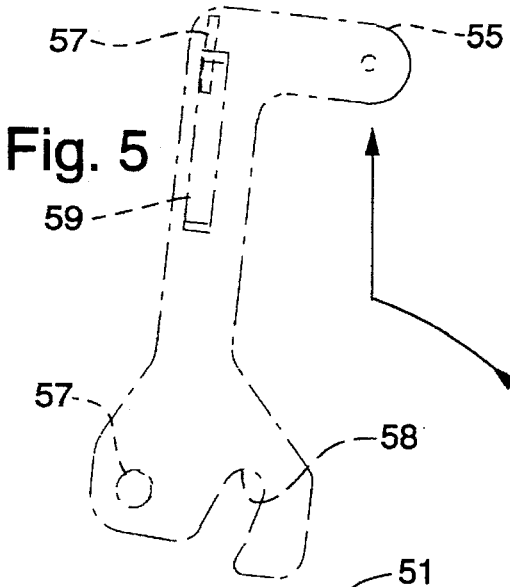
FIG. 5 is a left side elevational detail view of the rooster comb device mounting of the supporting frame to the upper mounting arm of a standard snow plow mount, the rest of the supporting frame and the snow plow mount hydraulic cylinder being broken away for purposes of clarity, the movement of the latching member to secure the mounting pin being shown in phantom.
Figure 6:
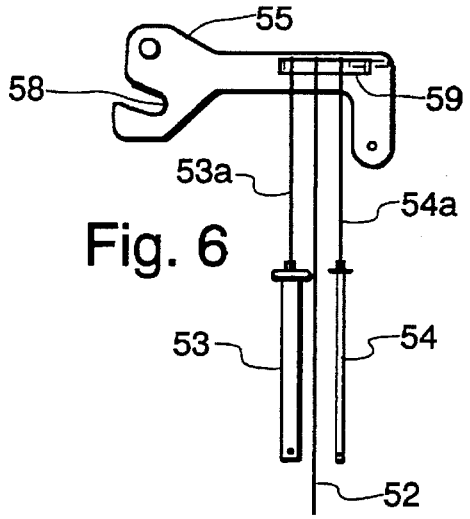
FIG. 6 is a side elevational detail view of the latching member.

A latching member 55 is attached to the rooster comb device 50 by a chain or cable 52 to prevent the latching member 55 from being lost when not in its operative position shown in solid lines in FIG. 5. The latching member 55 is formed from a pair of identical transversely spaced plates 56 secured in a spaced apart relationship by a pair of longitudinally spaced top gussets 57 connected thereto. The spacing of the plates 56 is such as to fit over the upper mounting arm 18, while the gussets 57 allow the latching member 55 to rest on top of the upper mounting arm 18. The plates 56 define a latching groove 58 which is directed slightly upwardly for purposes to be described in greater detail below. The latching member 55 also has attached thereto, by respective chains or cables 53*a* and 54*a*, a mounting pin 53 and a latching pin 54. A handle 59 provides a convenient means by which the chains or cables 52, 53*a* and 54*a* can be attached to the latching member 55.

Figure 7:
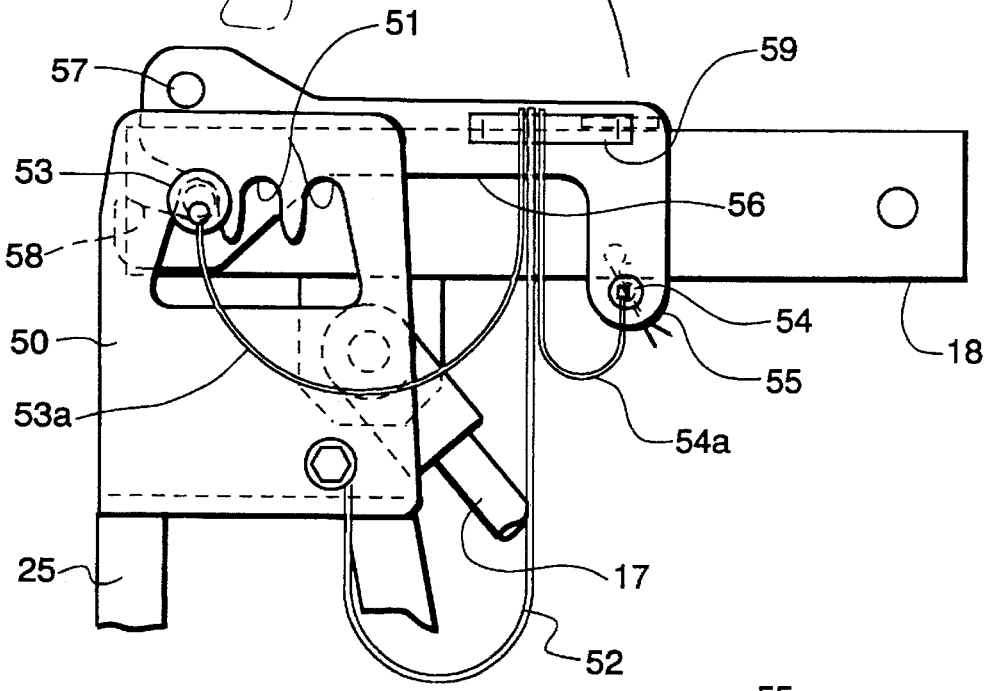
FIG. 7 is a top plan view of the rooster comb device shown in FIG. 5, the movement of the connecting pins securing the latching member to the rooster comb device and the upper mounting arm of the snow plow mount being shown in phantom.
Figure 7:
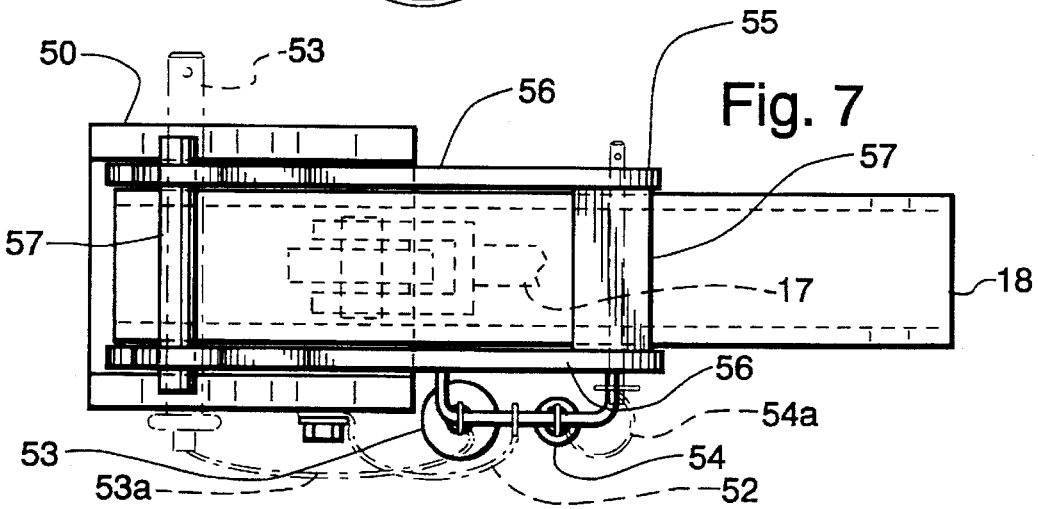

In operation, the hydraulic cylinder 17, forming part of the standard snow plow mounting apparatus 15, is manipulated by separate controls typically housed within the truck cab 12 to reach a generally horizontal orientation and, with appropriate fore-and-aft movements Of the truck 10, align the transverse hole 19 at the end of the upper mounting arm 18 with the general window opening of the rooster comb device 50, with the A-frame tower 25 of the supporting frame 20 in a generally vertical orientation. As best seen in FIG. 7, the rooster comb device 50 is configured to receive the upper mounting arm 18 therewithin.

The mounting pin 53 is then inserted through the rooster comb device 50 and transverse hole 19. A conventional cotter pin or clip (not shown) will keep the mounting pin 53 from being accidentally withdrawn back through the transverse hole 19. The hydraulic cylinder 17 of the snow plow mounting apparatus 15 is then actuated to raise the mounting arm 18, allowing the mounting pin 53 to seek the appropriate mounting groove 51. The latching member 55 is then positioned between the upper mounting arm 18 and the rooster comb device 50 with the mounting pin 53 received within the latching groove 58, using preferably a generally vertical movement of the latching member as depicted in FIG. 5. The latching member 55 is then pivoted about the mounting pin 53 until the latching member 55 is seated on top of the upper mounting arm 18 with the mounting pin 53 deeply received in the latching groove 58.

The latching pin 54 is then inserted through corresponding holes in the latching member 55 to be positioned beneath the upper mounting arm 18 to prevent the latching member 55 from becoming disengaged from the upper mounting arm 18. A conventional cotter pin or clip (not shown) will keep the latching pin 54 from being accidentally disengaged. The upwardly sloped latching groove 58 and the latching pin. 54 prevent the latching member 55 from sliding along the upper mounting arm 18, as the rearward end of the latching member 55 must be raised to allow the latching groove 58 to be slid along the mounting pin 53.

Disengagement of the latching member 55 is the opposite procedure to that identified above. First the latching pin 54 must be removed so that the latching member 55 can be pivoted upwardly about the mounting pin 53 and allow the latching member 55 to be disengaged therefrom. A withdrawal of the mounting pin 53 allows the upper mounting arm 18 to be freed from the rooster comb device 50. The disconnection of the supporting frame 20 from the lower mounting pins 16 will allow the supporting frame to be dismounted from the truck 10 and supported on the ground by the support legs 26 which have been lowered into a ground engaging position by the manipulation of the ratchet mechanism 28 as described above.

Figure 8:
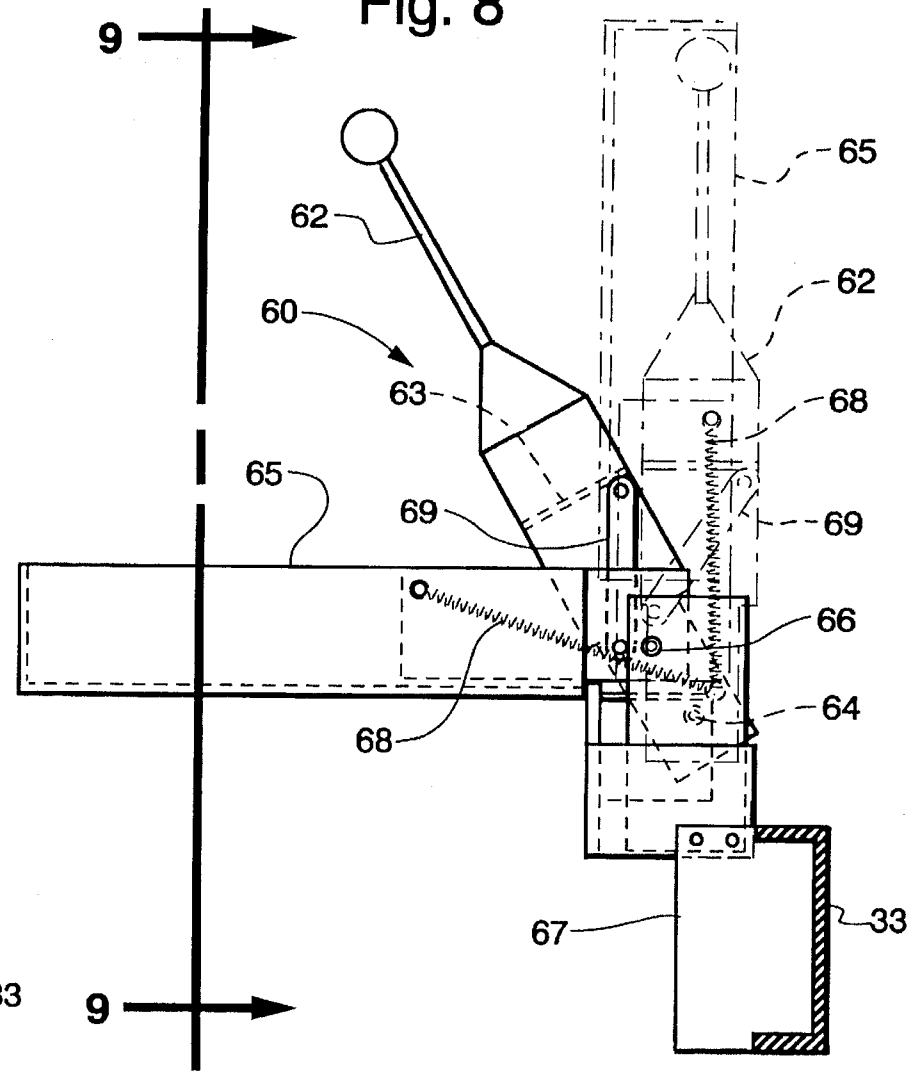
FIG. 8 is an enlarged side elevational detail view of the control panel containing the joy sick controllers shown in the operative position, the position of the controllers and the cover member being shown in phantom.
Figure 9:
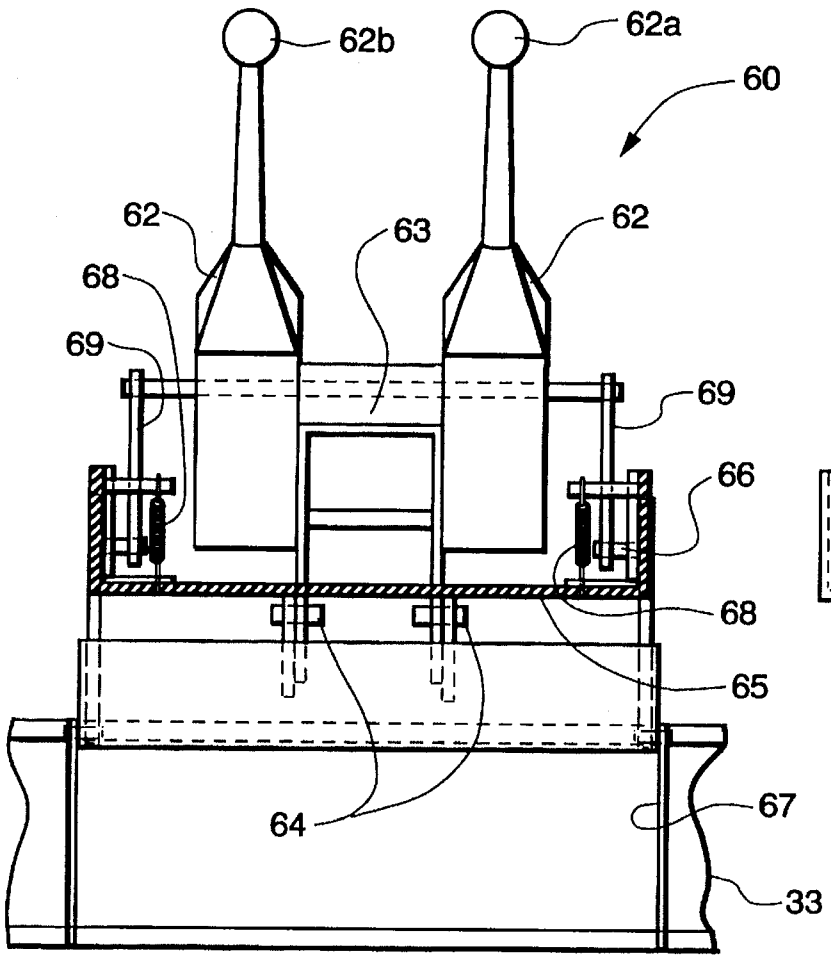
FIG. 9 is a front elevational detail view of the control panel shown in FIG. 8, the remainder of the supporting frame being broken away for purposes of clarity.

Referring now to FIGS. 1–4, but particularly to FIGS. 8 and 9, the details of the control panel 60 can best be seen. The control panel 60 is supported on the rotatable base frame member 33 to be rotatable therewith. Likewise, a spool valve 70 is also carried by the rotatable base frame member so as to maintain a spatial relationship between the control panel 60 and the spool valve 70, the operative control therebetween being provided by conventional push/pull cables (not shown) to operate the individual spools in a manner to be defined in greater detail below. The spool valve 70 is operatively connected to the hydraulic system carried by the truck 10 by flexible hoses (not shown) to receive a supply of hydraulic fluid under pressure therefrom.

The control panel 60 is movable between a transport position shown in phantom in FIG. 8 and an operative position shown in solid lines in FIGS. 8 and 9. The control panel includes a cover pan 65 having an open side facing a pair of joy stick controllers 62 so as to receive the joy stick controllers 62 within the cover pan 65 when in the transport position for protection of the controllers 62 from damage during transport over the highway. The cover pan 65 is pivotally connected at a pivot 66 to a mounting bracket 67 affixed to the rotatable base frame member 33 to allow pivotal movement thereof between a generally vertical transport position and a generally horizontal operative position.

The cover pan 65 is provided with a pair of transversely spaced overcenter springs 68 that are connected between the cover pan 65 and the mounting bracket 67 in such a manner as to exert a line of force on one side of the pivot 66 when the cover pan 65 is in the transport position to keep the cover pan 65 in the transport position, and on the opposing side of the pivot 66 when the cover pan 65 is in the operative position to keep the cover pan 65 in the operative position.

The joy stick controllers 62 are affixed to a U-shaped support bracket 63 which is pivotally connected to the mounting bracket 67 at a pivot 64 spaced from the pivot 66 to provide that the controllers 62 pivotally move in unison. A connecting link 69 pivotally interconnects the joy stick controllers 62 and the cover pan 65 in such a manner that the pivotal movement of the cover pan 65 about its pivot 66 imposes a corresponding pivotal movement of the controllers 62 about their pivot 64. The geometry of the connection between the connecting link 69 and the spaced apart pivots 64, 66 is such that the pivotal movement of the cover pan 65 through approximately 90° from the transport position to the operative position transfers a corresponding pivotal movement to the controllers 62 of approximately 30° so that the controllers 62 tilt out to a convenient operating position whenever the cover pan 65 is moved to the horizontal operating position.

The controllers 62 then operate in a conventional manner about two axes such that the up-and-down movement operates one spool, while the side-to-side movement of the same controller 62 operates a different spool. Accordingly, the two controllers will be operable to control the operation of a total of four individual spools to effect the control of the hydraulic system as described in greater detail below.

Figure 11:
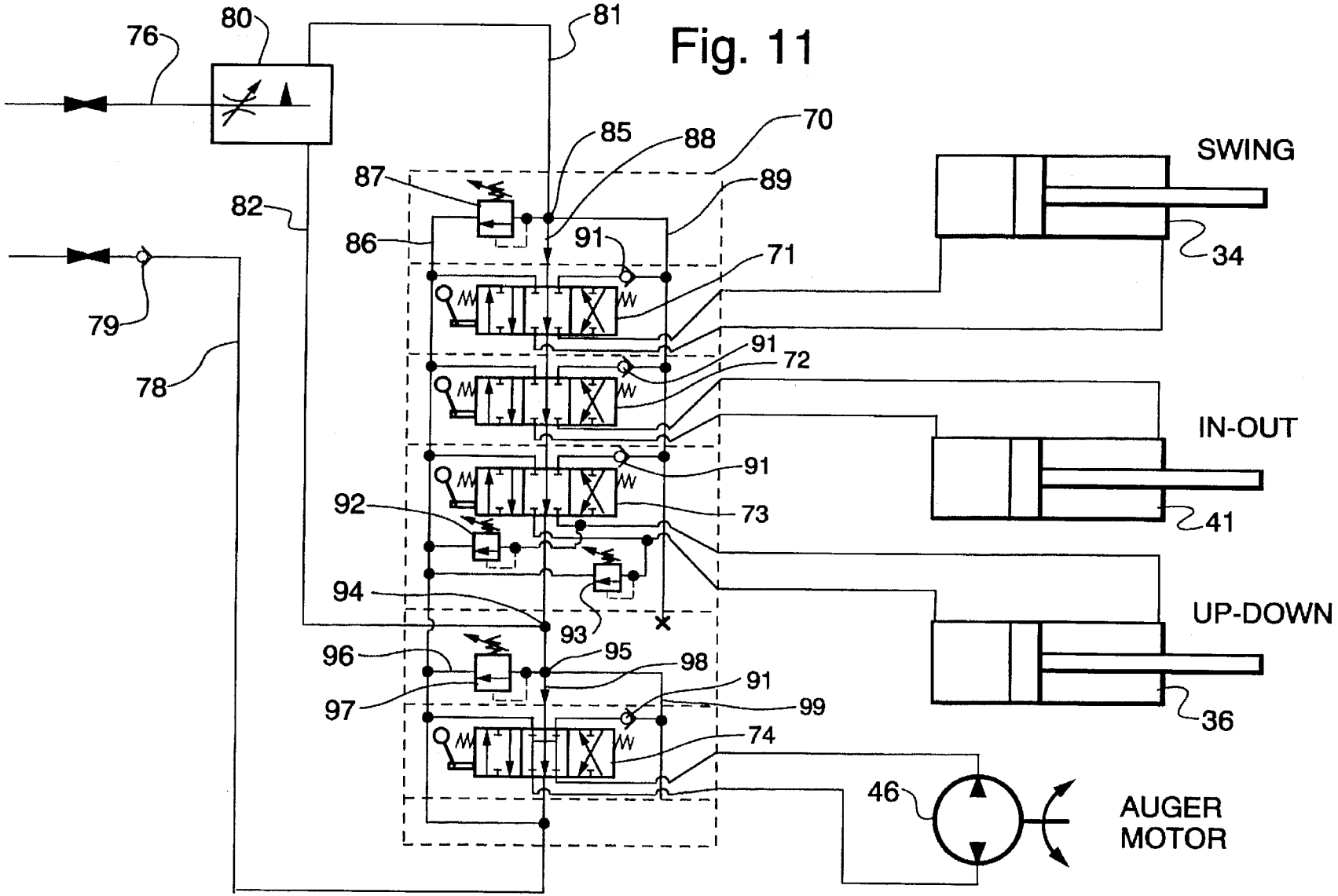
FIG. 11 is a diagrammatical view of the hydraulic control system controlling the operation of the supporting frame and the work implement, the source of hydraulic fluid under pressure being supplied from the truck on which the supporting frame is mounted.

Referring now to FIG. 11, the hydraulic control system can best be seen in a diagrammatic form. The valve body 70 includes four individual, three position spools 71, 72, 73 and 74, each of which are spring-loaded to the center position. The first spool 71 is operatively connected in flow communication with the first hydraulic cylinder 34 to control the rotational movement of the rotatable base frame member 33 relative to the fixed base frame member 23. The second spool 72 is operatively connected in flow communication with the third hydraulic cylinder 41 to control the pivotal movememt of the second boom member 40 relative to the first boom member 35 and provide the primary in-and-out extensible movement to the work implement 45.

The third spool 73 is operatively connected in flow communication with the second hydraulic cylinder 36 to control the pivotal movement of the first boom member relative to the rotatable base frame member 33 and provide the primary vertical movement to the work implement 45. The fourth spool 74 directs the flow of hydraulic fluid to the hydraulic motor 46 in selective opposing directions to power the operation of the work implement 45. The valve body 70 is connected in flow communication with the hydraulic system (not shown) of the truck 10 by a pair of hydraulic lines 76, 78, which incorporate a check valve 79 to assure the flow of fluid to the valve body 70 is in the proper direction, thereby preventing the backwards connection of the lines 76, 78 to the truck hydraulic system.

Hydraulic fluid enters the supply line 76 from the truck hydraulic system to a priority-type flow divider 80 that diverts a flow of approximately 2 gallons per minute (gpm) to a first input line 81 into the valve body 70 and the remaining flow from the truck hydraulic system into the second input line 82 into the valve body 70. The diversion of a constant flow of 2 gpm to the first input line 81 provides a constant feel to the operator manipulating the joy stick controllers 62 irrespective of what type of truck hydraulics are being used or the flow rate or output thereof.

The fluid entering the valve body 70 via the first input line 81 reaches a node 85 dividing the flow path into a return line 86 serving as a return manifold for each of the spools 71–74, a pass through line 88, and a inflow line 89 serving as an inflow manifold for the first three spools 71–73. A pressure relief valve 87 in the return line 86 prevents the flow of fluid through the return line 86 unless first passing through at least one of the first three spools 71–73, unless the pressure builds beyond the relief pressure. Each of the three positions of the spools 71–74 are provided with three ports on each side to correspond with the three flow paths 86, 88 and 89

The pass through line 88 feeds through the center port of each spool position. The center position of each spool 71–74 provides a straight through flow path to the next succeeding spool 72, 73, although the last spool 74 passes through to the return manifold 86. After exiting the third spool 73, the flow of 2 gpm is re-combined with the remaining fluid flow entering the valve body 70 through the second input line 82 to provide a full flow to the fourth spool 74. If any of the first three spools 71–73 are shifted out of the respective center position, the center port is blocked and the flow of fluid enters the shifted spool from the inflow manifold 89 to be supplied to the corresponding cylinder 34, 36 or 41 and then returned to the return manifold 86.

As a result, the operation of any of the first three spools to a non-center position diverts the 2 gpm flow to work in the corresponding cylinders 34, 36 and 41 and prevents the recombining of the 2 gpm flow with the fluid from the second input line 82. Check valves 91 in the inflow manifold prevent any back surge of hydraulic fluid back through the inflow manifold while any of the first three spools 71–73 are shifting from one position to another. Because of special operating pressure requirements of the second hydraulic cylinder 36, separate pressure relief valves 92, 93 are incorporated to protect the system from excessive pressures resulting from the operation of the second hydraulic cylinder 36.

The fluid entering the valve body 70 via the second input line 82 reaches a node 94 at which any flow arriving at the node 94 via the pass through line 88 is re-combined to continue to another node 95, which is similar to the node 85 in that the flow path is divided into three lines. A return line 96 is limited by a pressure relief valve 97, but connects back to the return manifold 86. A pass through line 98 is connected to the return manifold 86 on the opposing side of the fourth spool 74, which then returns the entire flow of fluid back to the truck hydraulic system via the return line 78. A inflow line 99 provides an operative flow of fluid to the working ports of the fourth spool 74 to direct the flow of hydraulic fluid to the hydraulic motor 46 for operation of the work implement 45.

Preferably, the arrangement with the joy stick controllers 62 is that the right hand controller **62*a* controls the shifting of the second spool 72 with the left-to-right movement of the controller 62*a* and the shifting of the third spool 73 with the up-and-down movement of the controller 62*a*. The left hand joy stick controller 62*b* then effects a shifting of the first spool 71 with the left-to-right movement of the controller 62*b* and the shifting of the fourth spool 74 with the up-and-down movement of the controller 62*b***.

Referring now to FIGS. 1, 3 and 4, an optional hook member 48 affixed to the inside arm **35*a* of the first boom member 35. The hook 48 can be utilized as a post puller in conjunction with the adjacent support leg 26 when pivoted into a ground engaging position to provide a mechanical leverage to pull broken posts from the ground when used with a chain and the retraction of the second hydraulic cylinder 36 to rotate the first boom member 35 about the pivotal connection thereof with the rotatable base frame member 33. Furthermore, the second boom member 40 is provided with a cradle 49 that is positioned to receive the distal tip of the work implement 45 when folded up to move into the transport position, as will be described in greater detail below. A pin (not shown) connected to the cradle 49 will retain the work implement 45 in a transport position engaged with the cradle 49** until released therefrom.

Referring now to FIGS. 1–4, but particularly to FIGS. **10*a* through 10*f*, the unfolding sequence to convert the supporting frame 20 from the transport position to an operative position can best be seen in a diagrammatic form. The supporting frame 20 is in the transport position in FIG. 10*a*, which corresponds to the orientation depicted in greater detail in FIG. 2. The work implement 45 is retained against the second boom member 35, latched within the cradle 49, and the first and second boom members 35, 40 are nested together and folded against the rotatable base frame member 33**.

Figure 10A:
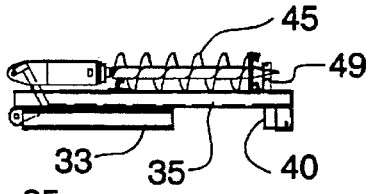
FIG. 10*a* through FIG. 10*f* are schematic front elevational views of the rotatable base member, extensible boom members and work implement, shown in the form of a post hole digger, depict the sequential orientations of the relative components to move the supporting frame from a nested transport position in FIG. 10*a* to an operative position in FIG. 10*f*.
Figure 10B:
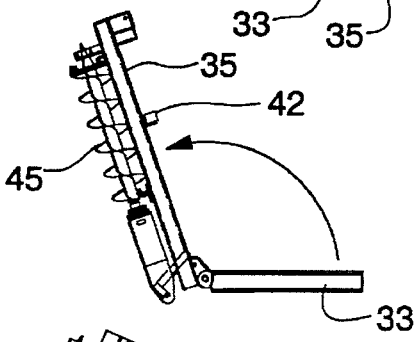
Figure 10C:
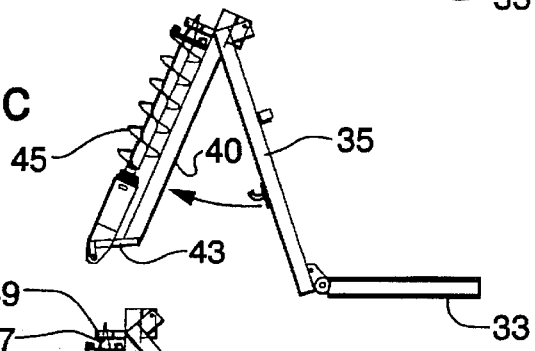

The first step, as demonstrated in FIG. 10*b*, is to raise the boom members 35, 40 in their nested orientation away from the rotatable base frame member 33 by extending the second hydraulic cylinder 36 to effect the pivotal movement of the first boom member 35 relative to the rotatable base frame member 33 until the first boom member 35 is in a generally vertical orientation. The third hydraulic cylinder 41 can then be actuated to effect a pivotal movement of the second boom member 40 out of its nested position within the first boom member 35. The second and third hydraulic cylinders 36, 41 can be appropriately manipulated to swing the work implement 45, which is still restrained within the cradle 49, to a generally vertical orientation, as shown in FIGS. 10*c* and 10*d*.

As an alternative not depicted in the drawings, the second and third hydraulic cylinders 36, 41 can be appropriately manipulated to place the work implement 45, still restrained within the cradle 49, in a generally horizontal orientation adjacent the ground G, except that this horizontal orientation will place a greater weight on the cradle 45 and may result in a more difficult task to release the work implement 45 from the cradle 49. Whether the work implement 45 is vertically or horizontally oriented, the next task, as depicted in FIG. 10*e*, is to release the work implement 45 from the cradle 49. Further manipulation of the second and third hydraulic cylinders 35, 41 will raise the work implement 45 above the ground G whereupon the work implement 45 will self-orient by gravity, due to the swivel 43 and pivot 44, into a vertical operating position, as shown in FIG. 10*f*.

Figure 10D:
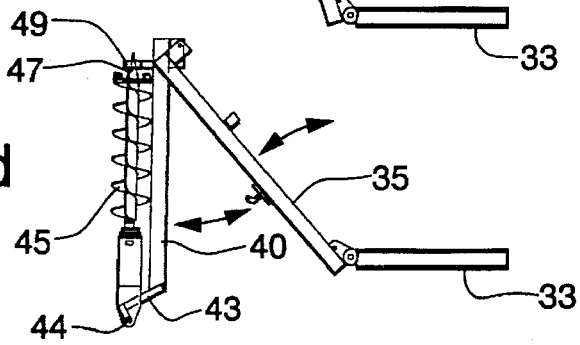
Figure 10E:
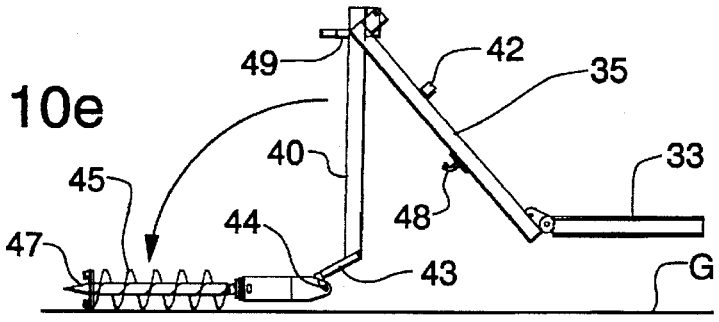
Figure 10F:
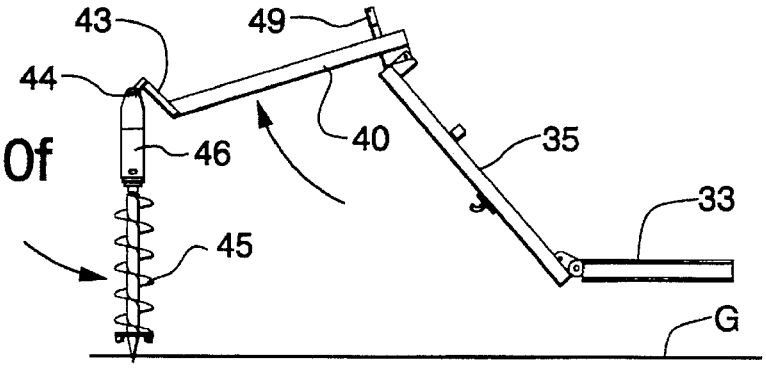

A conversion of the supporting frame 20 from the operating position shown schematically in FIG. 10*f*, and in greater detail in FIG. 1, to the nested transport position is substantially the reverse of the procedure described above. The first step is to manipulate the second and third hydraulic cylinders 36, 41 so that the work implement is resting on the ground G in a prone position. The work implement 45 must then be manually raised by grasping the remote tip 47 and pivoting the work implement 45 about the pivot 44 until engaging the cradle 49, whereupon the tip 47 is latched into the cradle 49.

The third hydraulic cylinder 41 can then be fully extended to rotate the second boom member 40 under the first boom member 35 until the second boom member 40 is nested between the double arms of the first boom member 35, as exhibited in FIGS. 10*d* to 10*b*. The second hydraulic cylinder 36 can then be retracted to pivot the first boom member 35 and the nested second boom member 40 into the folded position next to the rotatable base frame member 33, which places the work implement 45 on top of the folded and nested supporting frame 20 as depicted in FIG. 10*a*.

One skilled in the art will recognize that the above-described supporting frame could also be mounted on other types of vehicles to provide transport from job site to job site, including trailers, flat beds, service trucks, etc. The vehicle needed be self-propelled as would be the case with mounting the supporting frame on a trailer. In such cases, the structural interference between the fixed base frame member 23 and the rotatable base frame member 33, by reason that the A-frame tower 25 may not be a necessary part of the fixed base frame member 23, may not limit the relative rotational movement to about 37° and, in fact, could likely allow a 360° freedom of rotation. Likewise, the powering of the rotational movement may be accomplished through the use of a hydraulic motor and corresponding gearing, or other appropriate means, without departing from the principles of the invention.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. A supporting frame for a work implement to be mounted on a vehicle, including an operator's station having a line of sight looking in a forward direction of travel over said work implement, for transport of said work implement from one job site to another, comprising:

a base frame portion connected to said vehicle; and collapsible, nesting boom means pivotally connected to said base frame portion and having a remote end, said boom means being movable from a collapsed, transversely oriented transport position, in which said boom means is compactly folded into a nested configuration oriented transversely to the direction of travel of said vehicle and being positioned below said line of sight, to a variably positionable, extended operative position, said work implement being mounted on said remote end of said boom means and being extensible from said base frame portion through pivotal movement of said boom means, said boom means including:

a first boom member having a first end pivotally connected to said base frame portion and a distal end, said first boom member being defined by a pair of laterally spaced, longitudinally extending arms; and a second boom member pivotally connected to said distal end of said first boom member between the arms of said first boom member and having said remote end to which is mounted said work implement, said second boom member having a single arm construction, the pivotal connection between said first and second boom members being such that the second boom member is pivotally movable to a nested position in which said second boom member is positioned laterally between first boom member arms generally in a common plane therewith so as to minimize an overall vertical height of said boom means when placed into said transport position to facilitate the retention of said boom means below said line of sight, said work implement being extensible from a transport position adjacent said base frame portion through pivotal movements of said first and second boom members.

2. The supporting frame of claim 1 wherein the arms of said first boom member are oriented substantially parallel with said second boom member being pivotally connected between said first boom member arms.

3. The supporting frame of claim 2 wherein said base frame portion comprises:

a fixed base frame member secured to said vehicle; and a rotatable base frame member rotatably connected to said fixed base frame member for rotation about a generally vertical axis of rotation, said first boom member being pivotally mounted to said rotatable base frame member to be movable therewith to define a range of operation of said work implement as a function of the rotation of said rotatable base frame member relative to said fixed base frame member and the extensible pivotal movements of said first and second boom members.

4. The supporting frame of claim 3 wherein the remote end of said second boom member is provided with a swivel member to which said work implement is pivotally connected to provide said work implement with a capability of seeking a vertical orientation by gravity with a remote tip thereof being positioned below said swivel member when said work implement is lifted off the ground, said second boom member having a cradle member affixed thereto and being adapted to receive said remote tip of said work implement and fix said work implement in a transport position which is generally parallel to said second boom member.

5. The supporting frame of claim 4 wherein said first boom member, when in said transport position, is positioned above and generally parallel to said rotatable base frame member, said second boom member is nested between the respective arms of said first boom member and oriented generally parallel thereto, and said work implement being fixed to said cradle member and positioned on top of said first boom member generally parallel thereto.

6. A boom apparatus for supporting a work implement through a range of operative positions, comprising:

a base frame portion including:

a fixed base frame member; and a rotatable base frame member rotatably connected to said fixed base frame member for rotation about a generally vertical axis of rotation;

a first boom member having a first end pivotally mounted to said rotatable base frame member to be movable therewith to define a range of operation of said work implement as a function of the rotation of said rotatable base frame member relative to said fixed base frame member and a distal end, said first boom member being defined by a pair of laterally spaced, longitudinally extending arms; and a second boom member pivotally connected to said distal end of said first boom member and having a remote end to which is mounted said work implement, the pivotal connection between said first and second boom members being such that the second boom member is pivotally movable to a nested position in which said second boom member is positioned in a common plane with said first boom member, said work implement being extensible from a transport position oriented substantially transverse to said fixed base frame member and positioned adjacent said rotatable base frame member through pivotal movements of said first and second boom members, said second boom member being formed as a single arm which is positioned, when in said transport position, between said first boom member arms in said common plane therewith so as to minimize an overall vertical height of said boom apparatus when placed into said transport position.

7. The boom apparatus of claim 6 wherein said remote end of said second boom member is proximate to said first end of said first boom member when in said transport position, the remote end of said second boom member being extensible from the first end of said first boom member through the pivotal movement of said second boom member about said distal end of said first boom member.

8. The boom apparatus of claim 7 wherein the remote end of said second boom member is provided with a swivel member to which said work implement is pivotally connected to provide said work implement with a capability of seeking a vertical orientation by gravity with a remote tip thereof being positioned below said swivel member when said work implement is lifted off the ground, said second boom member having a cradle member affixed thereto and being adapted to receive said remote tip of said work implement and fix said work implement in a transport position which is generally parallel to said second boom member.

9. In a combination of a vehicle and a front mounted work implement, said vehicle including an operator's station having a line of sight looking in a forward direction of travel over said front mounted work implement, the improvement comprising:

a base frame portion detachably connectable to said vehicle; and a nestable boom means pivotally connected to said base frame portion to be extendible therefrom through a range of operation and having a transport position in which said boom means is compactly folded into a nested configuration oriented transversely to the forward of travel of said vehicle and being positioned below said line of sight, said boom means having a remote end supporting said work implement.

10. The combination of claim 9 wherein said boom means comprises:

a first boom member having a first end pivotally mounted to said base frame portion to be movable relative thereto and a distal end; and a second boom member pivotally connected to said distal end of said first boom member and having said remote end to which is mounted said work implement, the pivotal connection between said first and second boom members being such that the second boom member is pivotally movable to a nested position in which said second boom member is positioned generally in a common plane with said first boom member, said work implement being supported on said second boom member and being oriented substantially transverse to said forward direction of travel when in said transport position.

11. The combination of claim 10 wherein said base frame portion includes:

a fixed base frame member detachably connectable to said vehicle; and a rotatable base frame member rotatably connected to said fixed base frame member for rotation about a generally vertical axis of rotation, said first boom member being mounted on said rotatable base frame member for pivotal movement through said range of operation.

12. The combination of claim 11 wherein said first boom member is defined by a pair of laterally spaced, longitudinally extending arms, said second boom member having a single arm construction and being positioned laterally between first boom member arms generally in a common plane with said remote end of said second boom member being proximate to said first end of said first boom member when in said transport position, the remote end of said second boom member being extensible from the first end of said first boom member through the pivotal movement of said second boom member about said distal end of said first boom member.

13. The combination of claim 12 wherein said base frame member is supported from a three point hitch mechanism forming a part of said vehicle.

14. The combination of claim 13 wherein said boom means is positioned fully within a transverse profile of said vehicle with said first and second boom members being substantially perpendicular to said forward direction of travel when in said transport position.

* * * * *